US005491994A

United States Patent [19]

Baldyga

[11] Patent Number: 5,491,994

[45] Date of Patent: Feb. 20, 1996

[54] CRIMP HEIGHT MONITOR

[75] Inventor: Joseph W. Baldyga, Naples, Fla.

[73] Assignee: Diamond Die & Mold Company, Mt. Clemens, Mich.

[21] Appl. No.: 61,766

[22] Filed: May 14, 1993

Related U.S. Application Data

[63] Continuation of Ser. No. 804,969, Dec. 11, 1991, abandoned.

[51] Int. Cl.[6] ..... H01R 43/048

[52] U.S. Cl. ..... 72/20.1; 72/412; 29/705; 29/753

[58] Field of Search ..... 72/412, 414, 416, 72/20, 21, 386, 22, 453.13; 29/753, 705, 863; 267/119, 130

[56] References Cited

U.S. PATENT DOCUMENTS

| | | | |
|---|---|---|---|
| 3,253,451 | 5/1966 | Kerns et al. | 72/331 |
| 3,795,962 | 3/1974 | Baldyga | 29/203 D |
| 4,587,725 | 5/1986 | Ogawa et al. | 29/753 |
| 4,592,220 | 6/1986 | Martinez et al. | 72/19 |
| 4,599,887 | 7/1986 | Asai et al. | 72/21 |
| 4,654,952 | 4/1987 | Baldyga | 29/566.2 |
| 4,667,496 | 5/1987 | Asai et al. | 72/20 |
| 4,698,991 | 10/1987 | Kirii et al. | 72/21 |
| 4,856,186 | 8/1989 | Yeomans | 29/863 |
| 4,916,810 | 4/1990 | Yeomans | 29/753 |
| 4,939,918 | 7/1990 | Schoch | 72/20 |
| 5,113,756 | 5/1992 | Fujii | 72/21 |

*Primary Examiner*—Lowell A. Larson
*Assistant Examiner*—Thomas C. Schoeffler
*Attorney, Agent, or Firm*—Basile & Hanlon

[57] ABSTRACT

A terminal crimping apparatus for performing a crimping operation to crimp a wire barrel end of an electrical terminal on a stripped bare wire end of an electrical conductor, includes a reciprocal ram having a crimping tool cooperable with a crimping anvil and movable between a die open or ready position and a crimping position. The crimping apparatus also includes a device for monitoring the crimped height of the terminal on the conductor during each crimping operation. The monitoring device can be adjusted to accommodate different terminal and conductor configurations. Once calibrated, the monitoring device can be operated in an automatic mode and can be set to automatically stop the terminal crimping apparatus in the event that the crimped height of a terminal and conductor is greater than a selectable and setable high limit or is less than a selectable and setable low limit. The monitoring device operates on the principle that there is a relationship between crimping pressure and desired crimped height.

19 Claims, 4 Drawing Sheets

CRIMP HEIGHT MONITOR

This application is a continuation of application Ser. No. 07/804,969, filed on Dec. 11, 1991, now abandoned.

FIELD OF THE INVENTION

The present invention relates to an automatic mechanism for preparing wire sections for the application of terminals and the automatic attachment of terminals to a stripped bare wire end by means of a crimping press, and means for monitoring the crimp height of each completed crimped terminal on a wire end to determine if the terminal has been properly applied.

BACKGROUND OF THE INVENTION

Crimpable electrical terminals are frequently manufactured in the form of ladder strips. Terminals of this type are stamped and formed from flat strip stock in side-by-side relationship to each other with each terminal being integral at one end, or at both ends, with a carrier strip. Whether a carrier strip is provided along only one side of the terminal of strips or along both sides (in which case each terminal is integral with a carrier strip at both its forward end and its rearward end) will depend on the size of the terminal, the relative thickness of the stock metal, and the precise shape or configuration of the terminal. Where only one carrier strip is provided, the terminals are typically connected to the carrier strip at their rearward end; that is, at the end which is adapted to be crimped on to wires, for the reason that when the terminal is crimped between a pair of crimping dies it should be precisely positioned between the dies. In automatic and semi-automatic crimping machines having means for feeding the strip to position the leading terminal between the dies, more accurate positioning of the rearward end of the leading terminal between the dies can be achieved if this rearward end is rigidly connected to the carrier strip since the carrier strip will hold the rearward end in alignment with the dies whereas the frontal end might be slightly out of alignment if the leading terminal does not extend precisely normally from the carrier strip.

Electrical terminals to be crimped are fed in step-by-step movement to the apparatus integrally attached at one end to an elongate carrier strip, each step of movement of the carrier strip advancing a terminal into position on a stationary anvil of the crimping apparatus. The anvil is typically formed with a front flat surface lying in a general vertical plane and a vertically movable cutter element slides in face-to-face engagement with the front surface of the anvil. The face of the cutter engaged with the anvil is formed with a horizontal slot which slidably receives the carrier strip to properly locate the terminal relative to the anvil and, in a normally maintained rest position, to guide the terminal onto the upper surface of the anvil. A vertically movable die assembly is mounted above the anvil and a terminal is advanced to the anvil by driving the carrier strip forwardly while the die assembly is in a raised position. When the terminal is located on the anvil, a wire is moved into alignment with the terminal and the die assembly is driven downwardly to perform the crimping operation. During this downward movement of the die assembly, the die assembly engages the cutter and drives the cutter downwardly. The carrier strip is trapped within the horizontal slot in the cutter and upon downward movement of the cutter the terminal on the anvil is sheered from the carrier strip along the plane of engagement between the cutter and the vertical front face of the anvil. The die assembly is then raised and the cycle is repeated.

In order to produce a satisfactory mechanical and electrical connection between the wire and the terminal, the wire end, which is to be crimped to the terminal, must be moved into vertical alignment with the U-shaped portion of the terminal so that the wire is centered between the opposed legs of the U-shaped section immediately prior to the crimping of the legs onto the wire. Crimped terminal specifications are becoming increasingly stringent. In order to meet current specifications imposed by customers, it is desirable to achieve a crimped terminal with no missing wire strands and with no trapped wire insulation between the terminal and the wire strands. It is also desirable to eliminate or greatly reduce the amount of scrap terminals produced by a highly automated terminal crimping apparatus. Therefore, it is desirable to be able to measure and determine the accuracy of the crimped terminal to ensure that it is within predetermined guidelines. Furthermore, it is desirable to monitor the crimping operation so that if an automated terminal crimping apparatus does not produce a terminal within specifications, that terminal can be rejected as scrap, and/or the automated terminal crimping apparatus can be shut down for service before producing a large number of scrap crimped terminals.

SUMMARY OF THE INVENTION

Conventional elements of a crimping die apparatus with which the present invention is employed include an anvil and, mounted above the anvil, a vertically movable die assembly which carries a crimping die vertically aligned with the anvil. The crimping die is movable from a ready position spaced from the anvil to a crimping position where the die and anvil crimp a terminal supported on the anvil about a conductor previously stripped and positioned within the terminal.

In accordance with the present invention, means for monitoring the crimp height of a terminal on the stripped end of the electrical conductor during the crimping operation is provided. The monitoring means can include movable means for responding to crimping pressure during the crimping operation, biasing means for biasing the movable means against the crimping pressure by a predetermined or selected amount of force and measuring means for determining the amount of movement of the movable means with respect to a predetermined position corresponding to the desired crimp height.

The monitoring means can include a movable means for responding to the reciprocating movement of the crimping tool, biasing means for urging the movable means against the reciprocal movement of the crimping tool when traveling from the die open position to the crimping position and measuring means responsive to movement of the movable means for sending an output signal corresponding to the movable means position at the end of the crimping operation in relation to a predefined position defining the desired crimp height. The monitoring means can also include control means for calibrating the biasing means for different configurations of electrical terminals and electrical conductors. The control means can also include sensor adjustment means for setting a predetermined position corresponding to the desired crimp height for the particular electrical terminal and electrical conductor to be connected to one another. The sensor adjustment means can also include an upper adjustable setting and a lower adjustable setting defining the limits within which acceptable crimp heights have been reached, and means for stopping the crimping apparatus if the final height of a crimped terminal does not fall within this upper and lower range.

In operation, the present invention must be set up for the particular electrical terminal and electrical conductor to be crimped. The set-up procedure includes the steps of shutting off a pressurized fluid supply for biasing the movable means and releasing any residual pressure, manually setting the crimping tool stroke to the desired crimp height plus half the travel distance of the movable means, for example 0.25 millimeters (0.010 inches), turning on the pressurized fluid and setting the press to an established pressure, crimping a test terminal to a conductor and checking the crimp height of the crimped terminal on the conductor, adjusting the pressure up if the crimp height is high or adjusting the pressure down if the crimp height is low, until the desired crimp height is achieved. The initial set-up procedures can also include the steps of setting a liquid crystal display (LCD) to read the proper crimp height, and setting high and low crimp height parameters. Once the initial set-up is completed, the automatic crimping apparatus can be run continuously, and when an improper crimp height is sensed during the crimping operation, the monitoring means can be set to immediately stop operation of the automatic crimping apparatus and signal for operator intervention to determine the reason for the out of specification crimp height.

BRIEF DESCRIPTION OF THE DRAWINGS

In the drawings like reference numerals refer to like elements throughout the various views wherein.

DESCRIPTION OF THE PREFERRED AND ALTERNATIVE EMBODIMENTS

Figure 1:
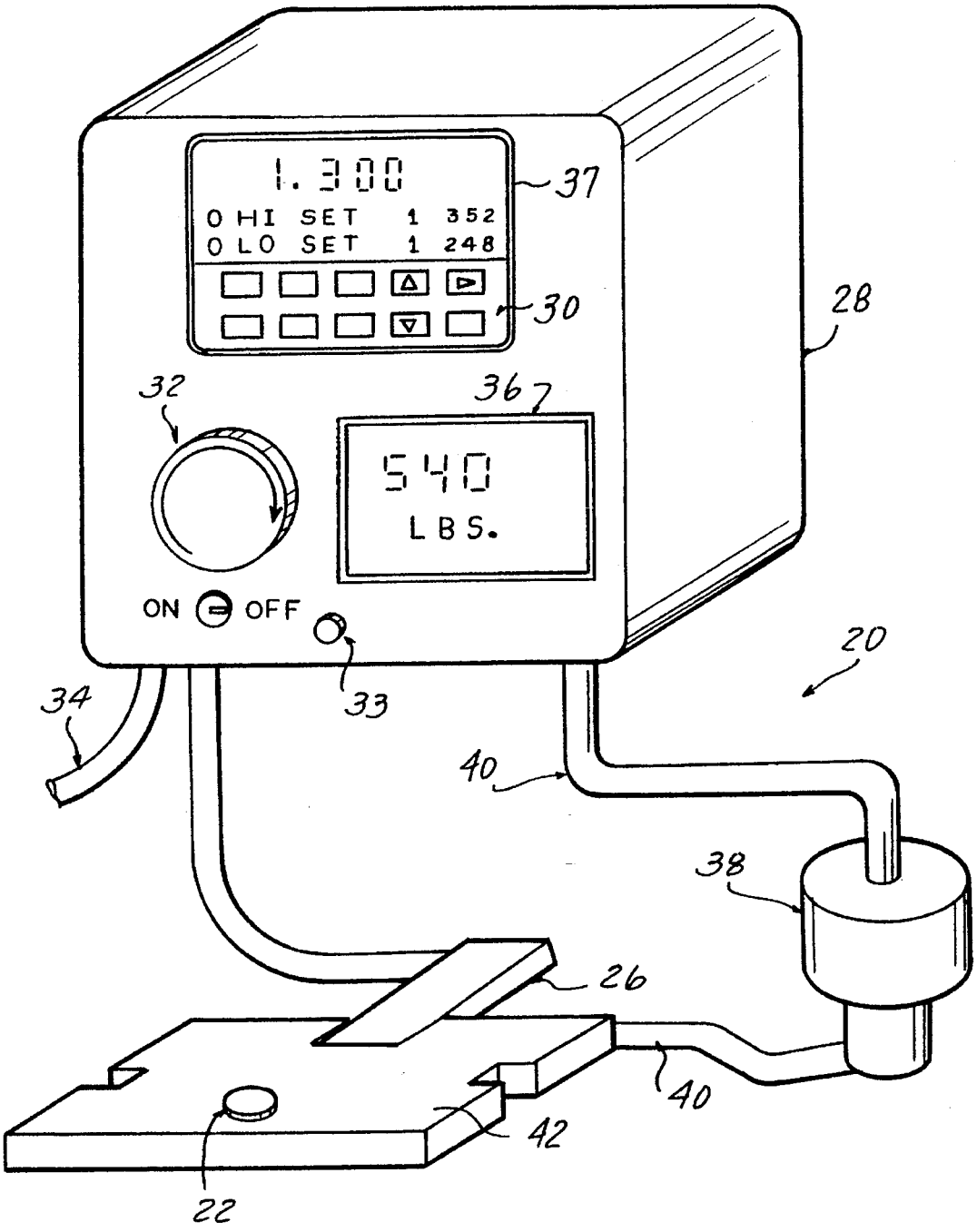
FIG. 1 is a perspective view of part of the apparatus used in the present invention for monitoring the crimp height during a crimping operation.

A crimping apparatus, designated generally as 10, according to the present invention includes an anvil 12 and a reciprocal die assembly carrying a crimping die or tool 14 aligned with the anvil 12. The crimping die 14 is movable from a ready position spaced from the anvil 12 to a crimping position where the die 14 and anvil 12 crimp a terminal 16 supported on the anvil 12 about a conductor 18 previously stripped and positioned within the terminal 16.

As shown in FIGS. 1–5, the present invention includes means 20 for monitoring the crimp height H of a terminal 16 on the stripped end of the electrical conductor 18 during the crimping operation. The monitoring means 20 can include movable means 22 for movably responding to crimping pressure during the crimping operation. The movable means 22 is urged by biasing means 24 against the crimping pressure by a predetermined or selected amount of force. Measuring means 26 is provided for determining the amount of movement of the movable means 22 with respect to a predetermined position corresponding to the desired crimp height H.

Referring now to FIG. 1, the monitoring means 20 can include control means 28 for calibrating the desired crimp height H. In addition, the control means 28 can include means 30 for inputting and for storing selected high and low crimp height H settings to define an acceptable range of crimp heights. Furthermore, the control means 28 can include means 32 for regulating a supply of pressurized fluid 34 such as compressed air. The regulating means 32 can also include display means 36 for indicating the current pressure setting. If necessary, the regulating means 32 may provide pressure increasing or multiplying means 38 if the desired pressure setting is greater than that provided by the supply of pressurized fluid 34. The pressure increasing means 38 may also act as a transition between one pressurized fluid, such as compressed air acting on one side of a piston and a second fluid such as hydraulic fluid which is pressurized to a higher pressure by the smaller end of the piston. In any case, pressurized fluid is supplied by passage means 40 in response to regulating means 32. Passage means 40 can be purged of pressurized fluid by pressure release means 33.

Figure 2:
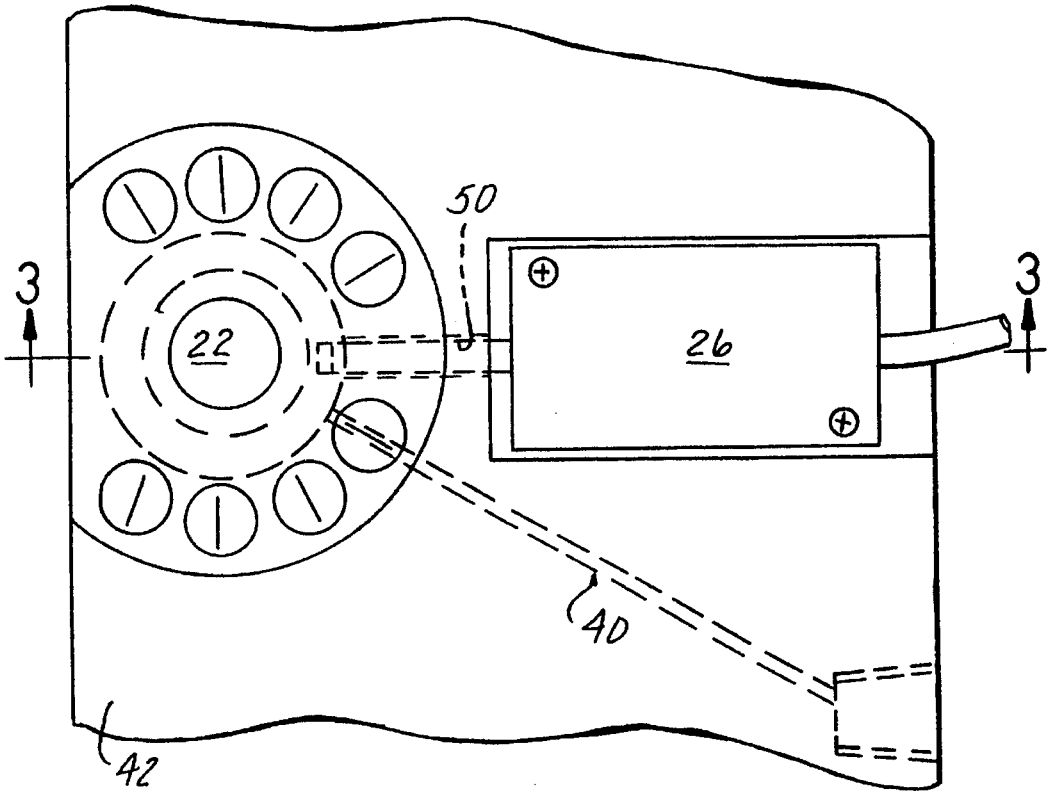
FIG. 2 is a plan view of a movable member and sensing means supported by a bolster plate of the crimping die apparatus of the present invention.
Figure 3:
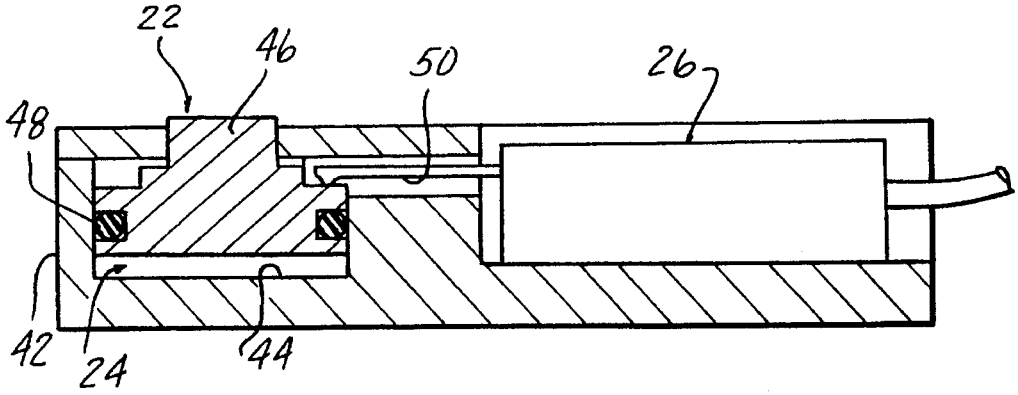
FIG. 3 is a cross-sectional view taken as shown in FIG. 2.

Referring now to FIGS. 2 and 3, the passage means 40 can pass through the bolster plate 42 and communicates with a pressure fluid chamber 44 defined between movable means 22 and bolster plate 42. The pressurized chamber 44 defines the preferred embodiment of the biasing means 24. The movable means 22 can include a piston-like member 46 reciprocally disposed within an aperture formed in the bolster plate 42. The piston-like member 46 supports an annular seal ring 48 for confining the pressurized fluid chamber 44. The piston-like member 46 is movable between first and second end limits of movement.

Figure 4:
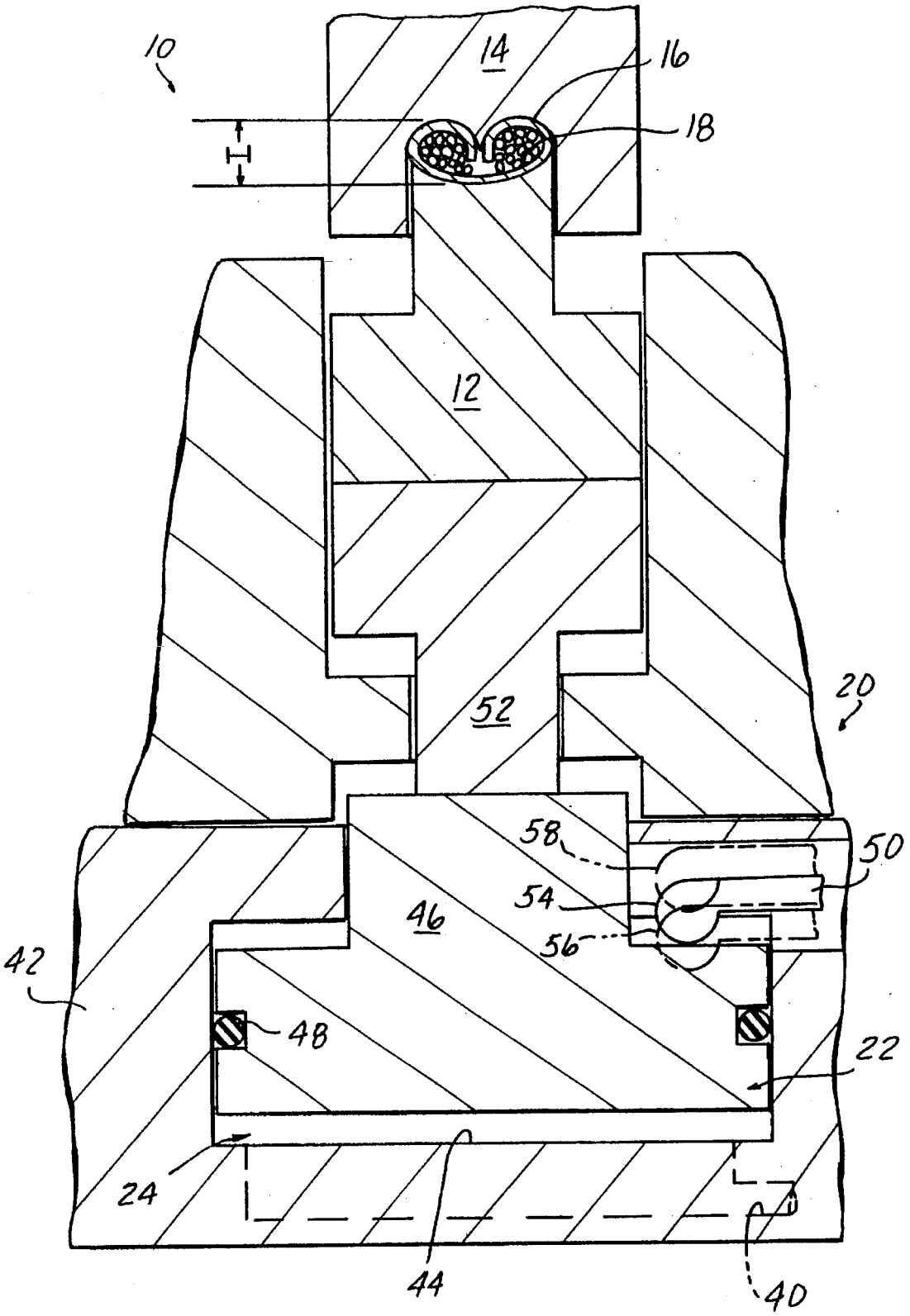
FIG. 4 is a detailed cross-sectional view of a preferred embodiment of the present invention.

The first end limit of movement is reached by the piston-like member 46 when chamber 44 has been depressurized. When in this first end limit of movement, the end of the piston-like member 46 opposite from the chamber 44 is flush with, or preferably protruding slightly from the upper surface of the bolster plate 42. Of course, as will be recognized after reading the remainder of this description, the end of the piston-like member 46 opposite the chamber 44 could be designed to be recessed from the top of the bolster plate 42, provided the anvil 12 remain connected in some manner to the piston-like member 46, such as through a protruding portion 52 of the anvil assembly into contact with the outwardly facing surface of the piston-like member 46 as shown in FIG. 4. It is also envisioned that the same sensing apparatus can be modified and applied to the crimping die or tool 14 portion of the apparatus 10 if desired, rather than the anvil 12, to obtain the desired measurement of the crimp height during the crimping operation in a similar manner to that described in detail here.

Figure 5:
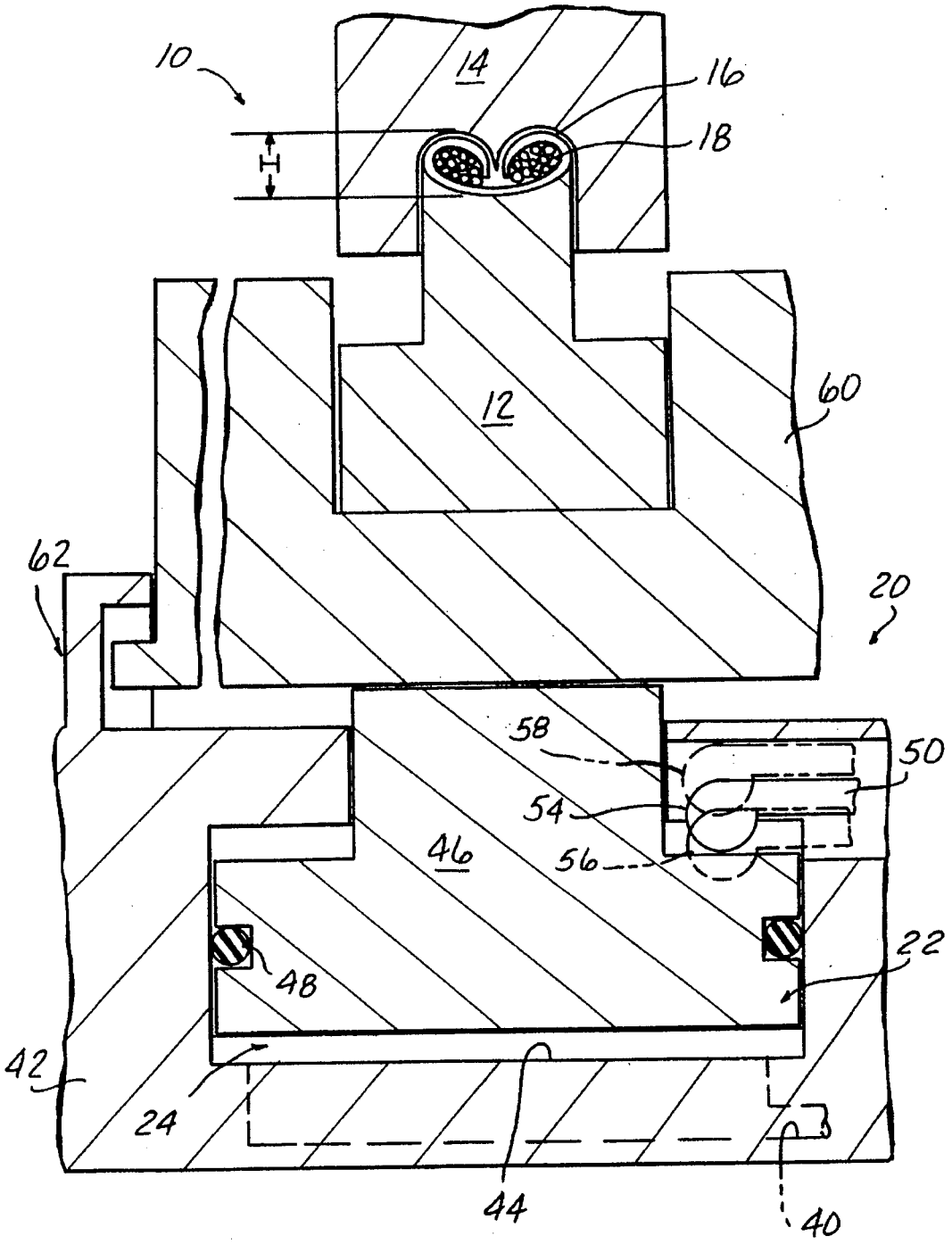
FIG. 5 is a detailed cross-sectional view of an alternative embodiment of the present invention.

With the crimping tool or die 14 in a ready or raised position, and the chamber 44 pressurized to the desired biasing pressure, the piston-like member 46 is normally disposed in the second end limit of movement. During each crimping operation, the movable member 22 will initially be at its outermost position corresponding to the second end limit of movement. With the crimping tool 14 in its ready position, the anvil 12 as shown in FIG. 4 or the entire anvil die assembly 60 as shown in FIG. 5, will also be in a corresponding outermost position with respect to the bolster plate 42. As also shown in FIG. 5, means 62 for slidably guiding and holding the anvil die assembly 60 with respect to the bolster plate 42 can be provided connected to the bolster plate 42. In any case, the crimping tool 14 is reciprocal from the ready position to a pre-calibrated, consistent crimping position, while the anvil 12 is movable between first and second positions corresponding to the distance of travel of the movable means 22. The movable means 22 previously being pre-calibrated so that a sensing wand 50 of measuring means 26 is in a position such as that shown in 54, midway between the first and second end limits of movement of the movable member 22, when the desired crimping height has been reached.

The measuring means 26 is supported in close proximity to the movable means 22. The measuring means 26 preferably includes a wand or lever 50 engageable with the movable means 22 for sensing movement of the movable means 22 during the crimping operation and for sending an output signal to the control means 28 corresponding to the movement of the movable member 22. An example of a commercially available measuring means 26, meeting the requirements for the present invention, can be obtained from ISK Transducer located at Fountain Valley, Calif., such as Model No. BDT-001.

Referring now to FIGS. 4 and 5, to calibrate the monitoring means 20 for the particular terminal 16 and conductor 18 to be connected to one another, chamber 44 is first depressurized allowing the movable means 22 to be positioned in an unbiased position at the first end limit of travel. The crimping tool is then reciprocated to its crimping position, where the tool 14 is in its closest proximity to the anvil 12. The distance between the tool 14 and anvil 12 is then manually adjusted to a position equal to the desired crimp height plus a predetermined distance preferably approximately equal to one-half of the travel distance of the movable member 22 between the first and second end limits of movement. For purposes of illustration, and not by way of limitation, the present invention has been found to be operable in an acceptable manner with the movable means 22 having a travel distance of 0.02 inch, therefore defining a predetermined distance to be added to the manual calibration setting of 0.01 inch. After manually setting the distance between the crimping tool 14 and the anvil 12, the crimping tool 14 is reciprocated away from the anvil 12. Chamber 44 is then pressurized to a predetermined pressure for the particular terminal 16 and conductor 18 to be crimped to one another. The predetermined pressure setting is established by trial and error for the particular terminal 16 and conductor 18 in question. It is anticipated that tables can be established for future use to identify the appropriate pressure setting necessary in order to achieve the desired crimping height.

After the initial biasing pressure is set in the chamber 44, a test terminal 16 and conductor 18 are crimped. The crimped terminal is measured in order to determine whether the machine has been properly calibrated. If the crimp height is high, the pressure within chamber 44 is adjusted upwardly, and if the crimp height is low, the pressure in chamber 44 is adjusted downwardly. The liquid crystal display 37 can then be set to display the proper crimp height, and the high and low shutoff settings can be input before the crimping apparatus 10 and monitoring means 20 run in the automated mode.

For example, and not by way of limitation, it has been found that a pressure of 540 pounds acting on a one square inch movable means 22 was sufficient to provide a crimp height of 1.300 millimeters when connecting a standard 0.016 metal thickness terminal to a standard 18 gauge conductor. The 540 pounds of pressure was generated through an air hydraulic pressure booster from a compressed air supply of 80 pounds per square inch. In this configuration, an acceptable high setting was found to be 1.352 millimeters and an acceptable low setting was found to be 1.248 millimeters.

The crimp monitor of the present invention uses the crimp pressure to obtain the required compactness which in turn relates to the proper crimp height. There is an established relationship between crimp height and compactness to obtain optimum electrical qualities and pull test requirements. Once the crimp pressure is established for a specific wire and terminal, the pressure will compensate for variations in wire, terminal metal thickness and lost strands of wire. With these conditions, the crimp height will vary when compacted by a specific pressure and the anvil or lower retainer will move the amount of the crimp height variations. The monitor means 20 of the present invention measures this variation and displays the crimp height on the liquid crystal display and signals a high and low shutoff if it senses a crimp height out of the preset tolerance range.

The present invention has been found to be capable of sensing crimp height as a terminal is being crimped to within 0.005 millimeters (0.0002 inch). The present invention also has been found to have high and low shutdown capabilities within 0.005 millimeters (0.0002 inch) and is adjustable with respect to the desired high and low settings. The present invention adjusts automatically to any changes in press shut height of 0.125 millimeters (0.005 inch). Tests with the present invention have shown that a variation in pressure will make a measurable difference in the crimp heights.

If for some reason the crimped terminal and conductor are smaller than the desired crimping height H, the sensing wand 50 would be at a position generally corresponding to that shown in phantom at 58, although it should be recognized that this is somewhat exaggerated for purposes of clarity in this drawing. This position of the wand would result in an appropriate signal being sent from the measuring means 26 to the control means 28 to indicate the actual crimped height of the terminal when the crimping tool 14 reaches its crimping position end limit of movement. If the crimped terminal is larger than the crimp height H desired, the wand 50 may take a position generally corresponding to that illustrated in phantom and designated as 56 in FIGS. 4 and 5. It should be recognized that this phantom position 56 is also somewhat exaggerated for purposes of illustration. An appropriate signal would be sent by the measuring means 26 to the control means 28 to indicate the actual crimped height of the terminal when the crimping tool 14 reaches its crimping position end limit of movement.

If the signal from the measuring means 26 indicates that the actual crimped height of the terminal and conductor is outside of the acceptable range previously set, the control means 28 can be configured to automatically cease the crimping operation and to signal for operator intervention to determine the cause of the error. This eliminates a large number of crimped terminals being produced which do not meet the required specifications, thereby reducing the amount of scrap generated making the crimping operation more cost efficient and productive.

While the invention has been described in connection with what is presently considered to be the most practical and preferred embodiment, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures.

What is claimed is:

1. A crimping apparatus for performing a crimping operation to crimp a wire barrel end of an electrical terminal on a stripped bare wire end of an electrical conductor, the crimping apparatus comprising:

a reciprocal ram having a crimping tool cooperable with a crimping anvil and movable between a first end limit of travel defining a die open position and a second end limit of travel defining a crimping position; and means for monitoring a crimped height of said terminal on said conductor during said crimping operation, said monitoring means including a movable member supporting the crimping anvil for movement responsive to crimping pressure applied during the crimping operation and a sensor in direct contact with the movable member during movement between said die open position and said crimping position for measuring physical displacement of the movable member at said second end limit of travel for comparison with respect to a predefined position corresponding to a desired crimp height and for sending an output signal corresponding to the measured variance in displacement.

2. The crimping apparatus of claim 1 wherein said monitoring means further comprises:

biasing means for urging said movable means against said crimping pressure by a selectable amount of force.

3. The crimping apparatus of claim 1 wherein said monitoring means further comprises:

control means for calibrating a desired crimp height.

4. The crimping apparatus of claim 3 wherein said control means further comprises:

means for inputting and for storing selected high and low crimp height settings to define an acceptable range of crimp heights.

5. The crimping apparatus of claim 3 wherein said control means further comprises:

means for regulating a supply of pressurized fluid.

6. The crimping apparatus of claim 5 wherein said control means further comprises:

display means for indicating a current pressure setting.

7. The crimping apparatus of claim 5 wherein said regulating means further comprises:

multiplying means for increasing force available from said supply of pressurized fluid.

8. A crimping apparatus for performing a crimping operation to attach a wire barrel end of an electrical terminal on a stripped bare wire end of an electrical conductor, the crimping apparatus comprising:

a reciprocable ram having a crimping tool cooperable with a crimping anvil and movable between a first end limit of travel defining a die open position and a second end limit of travel defining a crimping position;

movable means, supporting the crimping anvil and responsive to crimping pressure acting through said crimping tool and anvil, for generating physical movement relating to a crimp height of a wire barrel end of an electrical terminal on a stripped bare wire end of an electrical conductor disposed between the crimping tool and the crimping anvil in the crimping position;

biasing means for urging said movable means against crimping pressure applied by said crimping tool and anvil with a selected amount of force; and measuring means, responsive to movement of said movable means, for determining an amount of movement of said movable means and for generating an output signal relating to said amount of movement, said measuring means including a sensor in direct contact with the movable means during movement between said die open position and said crimping position for measuring physical displacement of the movable means at said second end limit of travel for comparison with respect to a predefined position corresponding to said desired crimp height and for sending an output signal corresponding to the measured variance in displacement.

9. The crimping apparatus of claim 8 further comprising:

control means for calibrating said biasing means and said measuring means to obtain a desired crimp height with a particular combination of said terminal and said conductor.

10. The crimping apparatus of claim 9 wherein said control means further comprises:

means for inputting and for storing selectable high and low crimp height settings to define an acceptable range of crimp heights.

11. The crimping apparatus of claim 10 wherein said control means further comprises:

means for regulating a supply of pressurized fluid to define an adjustable force for said biasing means.

12. The crimping apparatus of claim 11 wherein said control means further comprises:

display means for indicating a current adjustable force setting.

13. The crimping apparatus of claim 12 wherein said control means further comprises:

multiplying means for converting a regulated supply of pressurized fluid to a regulated higher pressurized supply of fluid.

14. A crimping apparatus comprising:

a reciprocal ram having a crimping tool cooperable with a crimping anvil and movable to a die open position allowing insertion of an electrical terminal and positioning of a stripped bare wire end of an electrical conductor in a wire barrel end of said electrical terminal and movable from said die open position at a first end limit of travel to a crimping position at a second end limit of travel to attach said electrical terminal to said electrical conductor during an automatic crimping operation;

a bolster plate for supporting said anvil, said bolster plate having an aperture formed therein;

a movable member reciprocally received within said aperture defining a fluid pressure chamber between said movable member and said bolster plate, said movable member in supporting contact with said anvil and responsive to crimping pressure applied during said crimping operation;

fluid passage means connected to said fluid pressure chamber;

a supply of pressurized fluid connected to said fluid passage means for pressurizing said fluid pressure chamber to bias said movable member against movement in response to said crimping pressure;

a single sensor for measuring displacement of said movable member with respect to a predefined position corresponding to a desired crimp height and for sending an output signal corresponding to said variance in displacement, said sensor in direct contact with the movable member during movement between said die open position and said crimping position for directly measuring physical displacement of the movable member at said second end limit of travel during the crimping operation; and control means responsive to said sensor output signal for allowing continued automatic crimping operation while said output signal falls within a predetermined range and for automatically terminating continued automatic crimping operations if said output signal falls outside said predetermined range.

15. The crimping apparatus of claim 14 wherein said control means further comprises:

means for inputting and for storing selectable high and low crimp height settings to define an acceptable range of crimp heights.

16. The crimping apparatus of claim 14 wherein said control means further comprises means for regulating said supply of pressurized fluid to define an adjustable pressurization for said fluid pressure chamber.

17. The crimping apparatus of claim 14 wherein said control means further comprises display means for indicating current pressure within said fluid pressure chamber.

18. A method for performing a crimping operation to attach a wire barrel end of an electrical terminal on a stripped bare wire end of an electrical conductor comprising the steps of:

positioning said terminal on an anvil;

supporting said anvil on a movable member;

inserting said stripped bare wire end of said conductor within said wire barrel end of said terminal;

crimping said terminal on said conductor with a die driven into cooperating engagement with said anvil; and while crimping, sensing a crimped height of said terminal on said conductor, wherein said sensing step further includes the steps of:

biasing said anvil in a first direction in opposition to crimping movement of said die with a bias force;

calibrating a defined position relating to a desired crimp height; and directly measuring physical displacement of said movable member supporting said anvil at an end limit of travel of said die for comparison with respect to said predefined position during said crimping step as an indication of actual crimp height with respect to said desired crimp height.

19. The method of claim 18 further comprising the steps of:

controlling subsequent crimping operations based on said sensed crimped height.

* * * * *